US007640990B2

(12) United States Patent
Ross et al.

(10) Patent No.: US 7,640,990 B2
(45) Date of Patent: Jan. 5, 2010

(54) FLOW CONTROL VALVE FOR INJECTION SYSTEMS

(75) Inventors: Donald Ross, Houston, TX (US); Yves Loretz, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 270 days.

(21) Appl. No.: 11/379,177

(22) Filed: Apr. 18, 2006

(65) Prior Publication Data

US 2007/0012454 A1 Jan. 18, 2007

Related U.S. Application Data

(60) Provisional application No. 60/595,590, filed on Jul. 18, 2005.

(51) Int. Cl.
*E21B 34/06* (2006.01)

(52) U.S. Cl. ..... 166/373; 166/305.1; 166/325

(58) Field of Classification Search ..... 166/305.1, 166/373, 374, 386, 325, 321, 169, 279, 263
See application file for complete search history.

(56) References Cited

U.S. PATENT DOCUMENTS 2,300,348 A * 10/1942 Dana ..... 166/302
3,087,551 A * 4/1963 Kerver ..... 166/317
4,601,342 A 7/1986 Pringle
5,127,474 A 7/1992 Schroeder
5,190,106 A 3/1993 Johnston
5,469,878 A 11/1995 Pringle
5,924,490 A 7/1999 Stone
6,276,458 B1 8/2001 Malone et al.
2003/0141061 A1 7/2003 Hailey, Jr.
2003/0188871 A1 10/2003 Dusterhoft
2004/0040718 A1 3/2004 Rhodes

* cited by examiner

*Primary Examiner*—Jennifer H Gay
*Assistant Examiner*—Elizabeth C Gottlieb
(74) *Attorney, Agent, or Firm*—Winstead PC; Daryl R Wright; James L Kurka

(57) ABSTRACT

A flow control valve for use inside a wellbore. In one implementation, the flow control valve may include a housing, a chamber disposed inside the housing and an entry port disposed at a first end of the chamber. The entry port may be configured to allow fluid to enter into the chamber. The flow control valve may further include an exit port disposed at a second end of the chamber. The second end may be opposite of the first end and the exit port is configured to allow fluid to flow out of the chamber. The flow control valve may further include a check valve assembly disposed between the entry port and the exit port. The check valve may be configured to allow fluid to flow from the entry port to the exit port and to prevent fluid to flow from the exit port to the entry port.

6 Claims, 3 Drawing Sheets

Prior Art

FLOW CONTROL VALVE FOR INJECTION SYSTEMS

CROSS-REFERENCE TO RELATED APPLICATIONS

This application claims benefit of U.S. provisional patent application Ser. No. 60/595,590 filed Jul. 18, 2005, which is herein incorporated by reference.

BACKGROUND

1. Field of the Invention

Implementations of various technologies described herein generally relate to flow control valves for injection systems.

2. Description of the Related Art

The following descriptions and examples are not admitted to be prior art by virtue of their inclusion within this section.

In general, injection operations involve pumping fluid into a well. Injection may be used in a number of applications to support the production of hydrocarbons, such as for pressure maintenance, for voidage replacement, for fluid disposal and the like. During injection operations, surface fluid may be pumped into a well under very high pressures. When the pumping is stopped, the stabilizing downward pressure is removed. The downward momentum of the fluid generates pressure waves that travel downward through the completion string and into the formation. These pressure waves may reverberate through the formation and may be reflected back by the completion string, the wellbore annulus, and the formation itself. The pressure waves may continue to resonate until the wave is fully dampened. This phenomenon may be known as the hammer effect.

The hammer effect can cause damage to the reservoir and components of the completion string. The primary cause of damage may not necessarily be the pressure waves themselves, but rather the fluid flowing in and out of the formation as a result of the pressure waves. Possible reservoir damage may include a collapsed hole, damaged perforations, a plugged screen, increased formation damage and destabilized sand or shale, which may ultimately lead to a decrease in injectivity. If injectivity is lost in whole or in part, the sweep efficiency and injectivity of the well may be jeopardized, which may in turn impact the ultimate efficiency of the injection operation.

SUMMARY

Described herein are implementations of various technologies for a flow control valve for use inside a wellbore. In one implementation, the flow control valve may include a housing, a chamber disposed inside the housing and an entry port disposed at a first end of the chamber. The entry port may be configured to allow fluid to enter into the chamber. The flow control valve may further include an exit port disposed at a second end of the chamber. The second end may be opposite of the first end and the exit port may be configured to allow fluid to flow out of the chamber. The flow control valve may further include a check valve assembly disposed between the entry port and the exit port. The check valve may be configured to allow fluid to flow from the entry port to the exit port and to prevent fluid to flow from the exit port to the entry port.

Described herein are also implementations of various technologies for a completion string for use inside a wellbore. In one implementation, the completion string may include a tubing and one or more flow control valves disposed on a side portion of the tubing. Each flow control valve may include an entry port for providing a flow path between an inside portion of the tubing and the flow control valve, an exit port for providing a flow path between the flow control valve and an outside portion of the tubing and a check valve assembly disposed between the entry port and the exit port. The check valve assembly may be configured to allow fluid to flow from the inside portion of the tubing to the outside portion of the tubing through the entry port, the check valve assembly and the exit port. The check valve assembly may be configured to prevent fluid to flow from the outside portion of the tubing to the inside portion of the tubing through the exit port, the check valve assembly and the entry port.

Described herein are also implementations of various techniques for injecting fluid to an earth formation through a completion string having one or more flow control valves disposed thereon. In one implementation, the completion string may be deployed inside the wellbore such that the one or more flow control valves are positioned proximate one or more earth formations. Each flow control valve may include a check valve assembly configured to allow fluid to flow from the completion string to one of the earth formations and to prevent fluid to flow from the one of the earth formations back into the completion string. Fluid from the surface may then be pumped into the completion string.

The claimed subject matter is not limited to implementations that solve any or all of the noted disadvantages. Further, the summary section is provided to introduce a selection of concepts in a simplified form that are further described below in the detailed description section. The summary section is not intended to identify key features or essential features of the claimed subject matter, nor is it intended to be used to limit the scope of the claimed subject matter.

BRIEF DESCRIPTION OF THE DRAWINGS

Implementations of various technologies will hereafter be described with reference to the accompanying drawings. It should be understood, however, that the accompanying drawings illustrate only the various implementations described herein and are not meant to limit the scope of various technologies described herein.

DETAILED DESCRIPTION

As used here, the terms "up" and "down"; "upper" and "lower"; "upwardly" and downwardly"; "below" and "above"; and other similar terms indicating relative positions above or below a given point or element may be used in connection with some implementations of various technologies described herein. However, when applied to equipment and methods for use in wells that are deviated or horizontal, or when applied to equipment and methods that when arranged in a well are in a deviated or horizontal orientation, such terms may refer to a left to right, right to left, or other relationships as appropriate.

Figure 1:
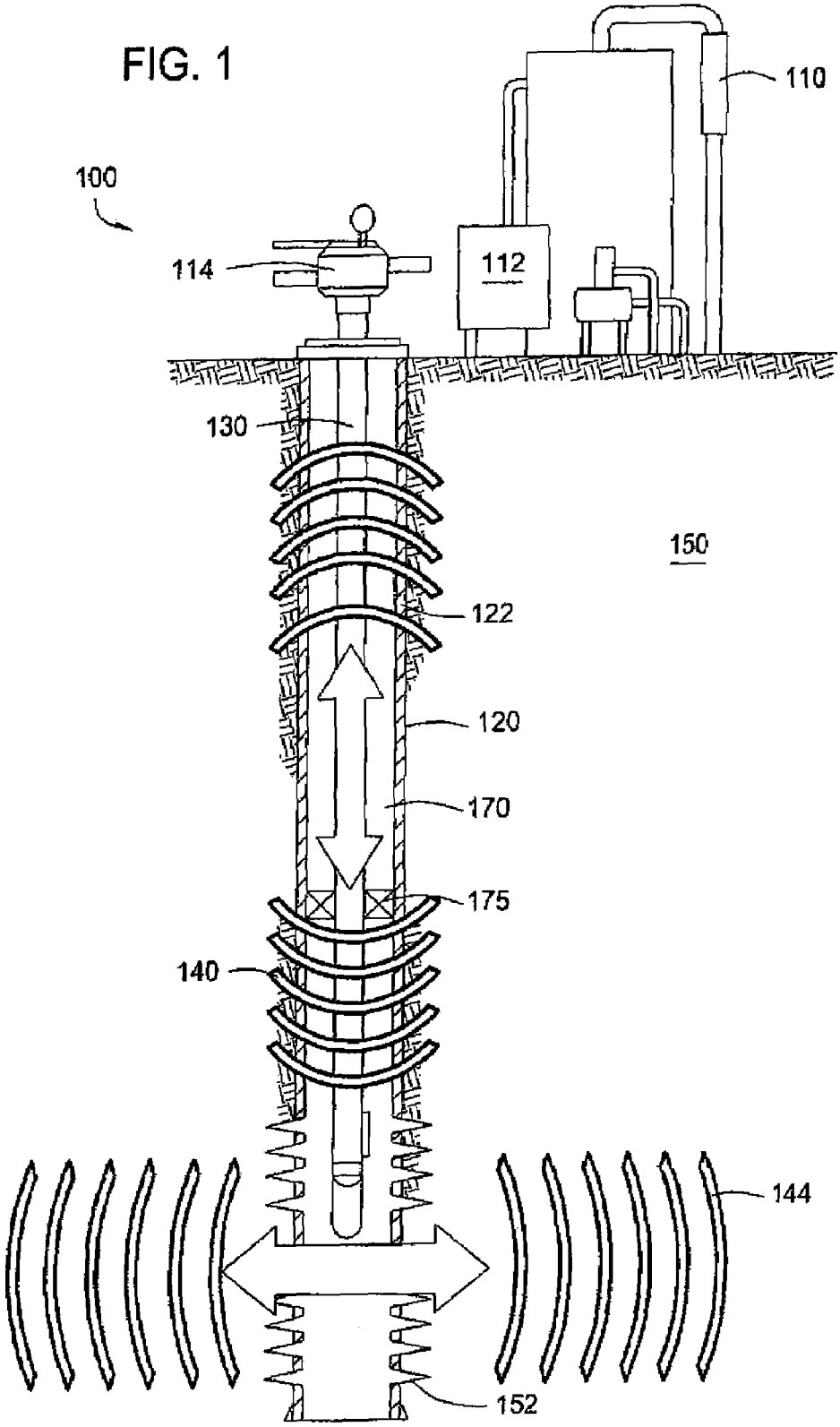
FIG. 1 illustrates the hammer effect that may occur with a typical injection system.

FIG. 1 illustrates a schematic diagram of a typical injection system 100, which may include a surface storage system 110 in communication with a high pressure pump 112, which may be in communication with a wellhead 114. The injection system 100 may further include a completion string 130 disposed inside a wellbore 120. As previously mentioned, the injection system 100 may be used for pressure support or voidage replacement. The wellbore 120 may be cased with a casing 122. However, in some implementations, the wellbore 120 may be left open. During an injection process, fluid from the surface storage system 110 may be pumped by the high pressure pump 112 through the wellhead 114 into the completion string 130. Examples of the pumped fluid may include water, inert or reactive gases, steam, waste products or combinations thereof. The pumped fluid may flow downward through the completion string 130 into the formation 150 through a set of perforations 152. Such perforations are typically formed by firing perforating shaped charges through the casing 122 using a perforating gun. The injection system 100 may further include a set of packers 175 that may be used to isolate any fluid or pressure wave coming out of the formation 150.

Once the pumping is stopped, the momentum of the fluid may generate pressure waves that initially proceed downward through the completion string 130 as downward waves 140. The pressure waves may continue into the formation 150 as formation waves 144. Through this process, some of the pressure waves may be reflected at various interfaces, such as the end of the completion string 130, where the casing 122 may interface with the formation 150 and the bottom of the wellbore 120. The reflection of the pressure waves may create a hammer effect in the completion string 130 and the wellbore annulus 170, i.e., the pressure waves may in turn be reflected at the wellhead 114 and reverberate in the completion string 130 and in the formation 150. This hammer effect may continue to reflect back and forth in a sinusoidal motion until the effect is dampened. Repeated oscillations by the pressure waves going back and forth at the formation interface may cause various types of wellbore damage, such as a collapsed hole, damaged perforations, plugged screens or formation skin damage.

Figure 2:
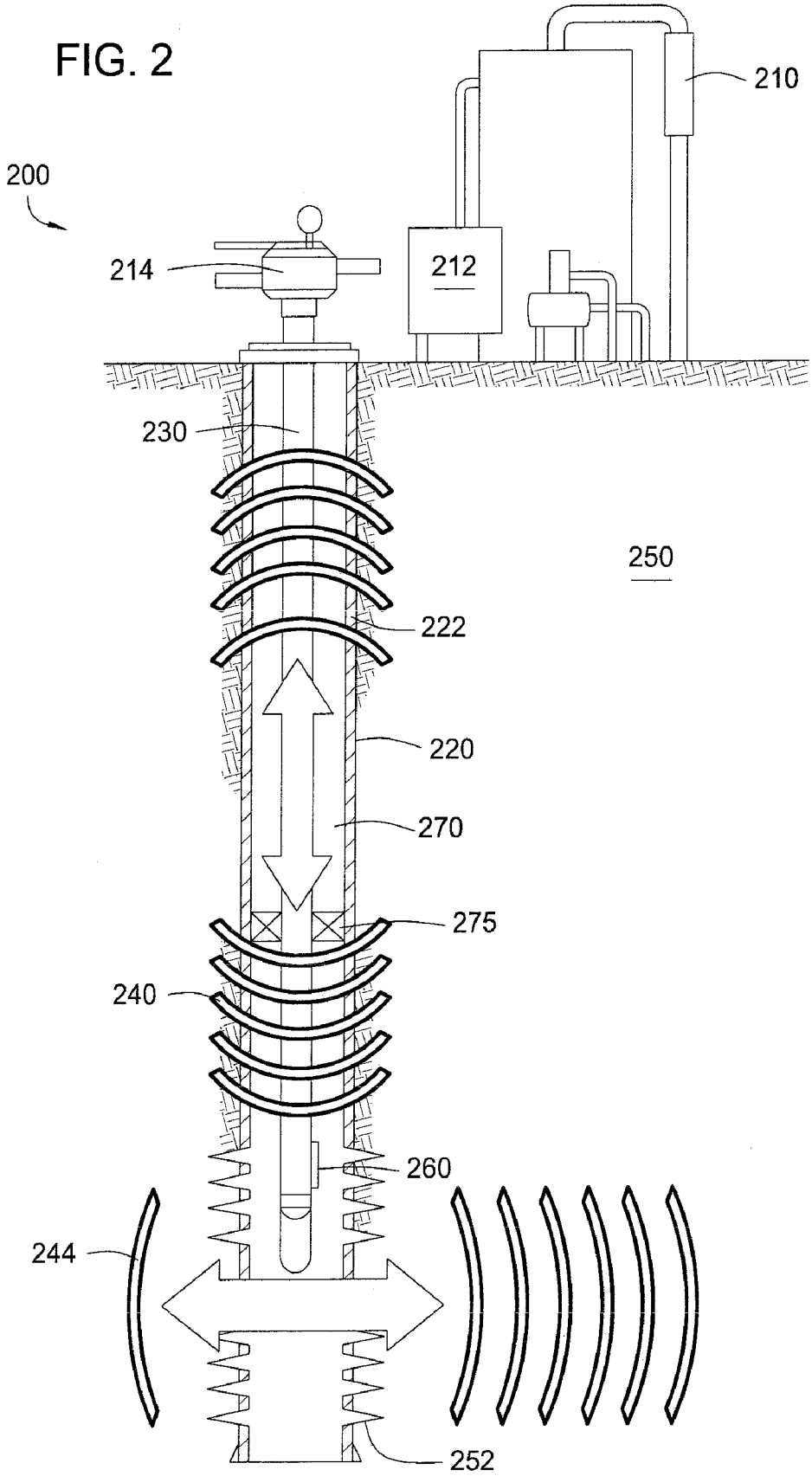
FIG. 2 illustrates a schematic diagram of an injection system in accordance with implementations of various technologies described herein.

FIG. 2 illustrates a schematic diagram of an injection system 200 in accordance with implementations of various technologies described herein. The injection system 200 may include a high pressure pump 212, which may be in communication with a wellhead 214. The injection system 200 may further include a completion string 230 disposed inside a wellbore 220, which may be cased with a casing 222. During injection, fluid from the surface storage system 210 may be pumped by the high pressure pump 212 through the wellhead 214 into the completion string 230. The pumped fluid may flow downward through the completion string 230 into the formation 250 through a set of perforations 252. The injection system 100 may further include a set of packers 275 that may be used to isolate any fluid or pressure wave inside the annulus between the completion string 230 and the casing 222. Since the above mentioned components of the injection system 200 are substantially similar or the same as the components of the injection system 100, other details about those same or similar components may be provided in the above paragraphs with reference to FIG. 1.

In one implementation, the injection system 200 may include a flow control valve 260 disposed near an injection zone on the completion string 230. The flow control valve 260 may be configured to prevent fluid from the formation 250 and the annulus 270 to flow back into the completion string 230 through the flow control valve 260. After the surface fluid pumping is stopped, the momentum of the fluid may still generate pressure waves that initially proceed downward through the completion string 230 as downward waves 240. The pressure waves may still continue into the formation 250 as formation waves 244. However, the back flow of fluid from the formation 250 may be prevented by the flow control valve 260 from re-entering the completion string 230. Although the flow control valve 260 may not prevent pressure oscillations in the completion string 230 from developing, it may significantly reduce the pressure waves going back and forth at the formation interface, thereby minimizing potential damage to the formation 250. Although the injection system 200 is described herein with reference to one flow control valve, it should be understood that, in some implementations, multiple flow control valves may be used to treat multiple zone completions, as will be described in the paragraphs below.

Figure 3A:
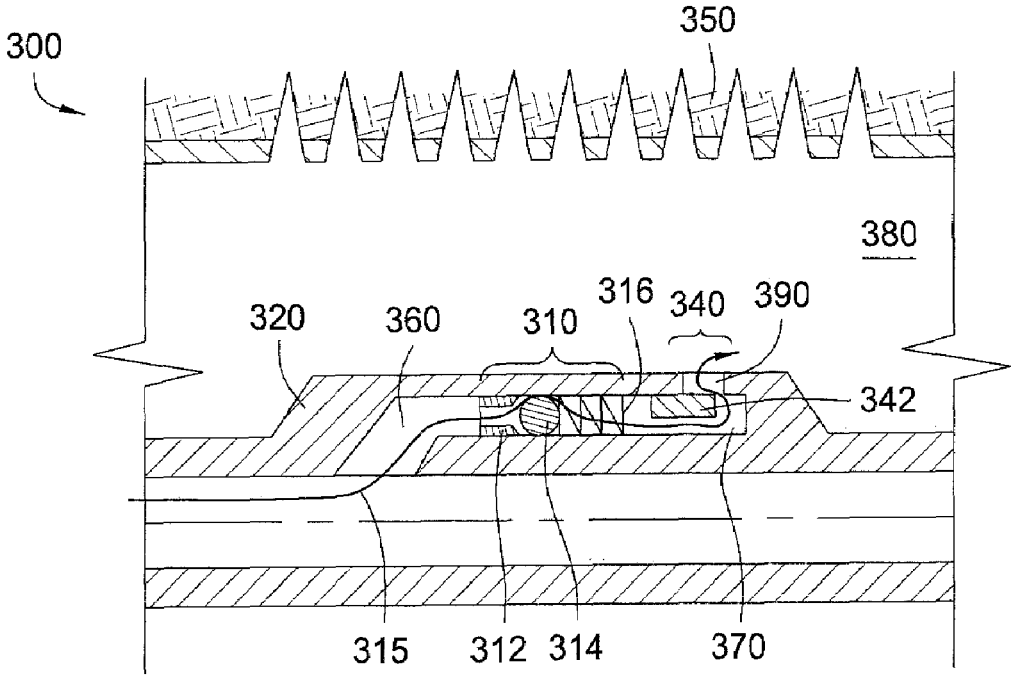
FIG. 3A illustrates a schematic diagram of a side cross sectional view of an exemplary flow control valve in accordance with implementations of various technologies described herein.

FIG. 3A illustrates a schematic diagram of a cross sectional side view of an exemplary flow control valve 300 in accordance with implementations of various technologies described herein. The flow control valve 300 may include a check valve assembly 310 and a choke assembly 340 disposed inside a housing 320, which may radially extend beyond the diameter of a completion string 330. The housing 320 may include an entry port 360 and an exit port 390. The entry port 360 may be configured to facilitate fluid to flow from inside the completion string 330 into the flow control valve 300. The exit port 390 may be configured to facilitate the fluid to flow from inside the flow control valve 300 or chamber 370 to the annulus 380 and the formation 350.

The check valve assembly 310 may include a ball seat 312, a ball 314 and a spring 316, which may be configured to exert a predetermined amount of force against the ball 314. In a closed position, the predetermined amount of force exerted by the spring 316 is sufficient to press the ball 314 against the ball seat 312. As such, the check valve assembly 310 is a normally closed system such that when no pressure is applied against it, the ball 314 sits against ball seat 312 closing off fluid passage through the housing 320. The predetermined amount of force exerted by the spring 316 may be varied based on requirements of a specific completion solution.

Figure 3B:
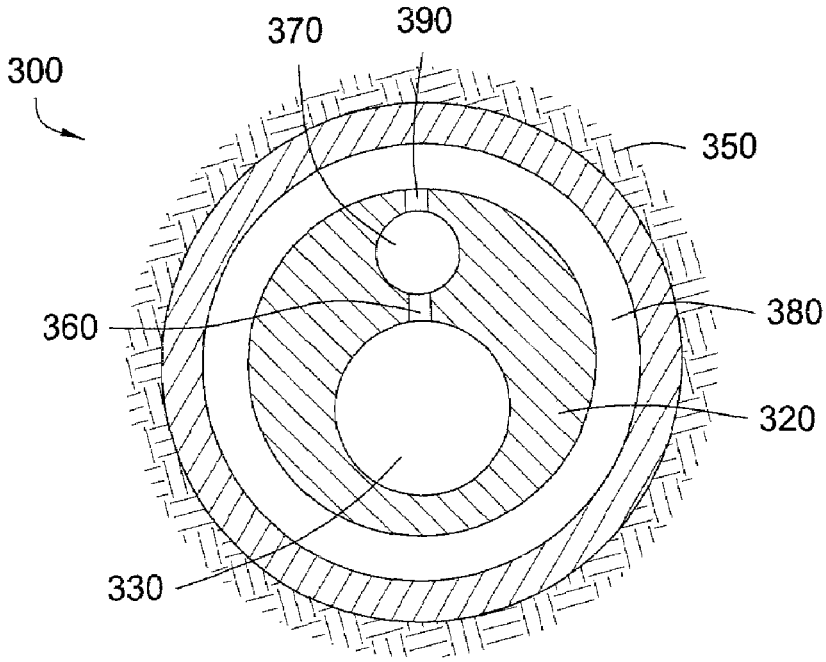
FIG. 3B illustrates a schematic diagram of a cross sectional view of the flow control valve illustrated in FIG. 3A.

The choke assembly 340 may include a choke 342 movably secured within the housing 320 at or near the exit port 390. The choke 342 may be configured to partially or completely cover the exit port 390. In this manner, the choke assembly may be used to control the flow of fluid into and out of flow control valve 300. A schematic diagram of a cross sectional view of the flow control valve 300 is shown in FIG. 3B.

In operation, as fluid is pumped from the surface into the completion string 330, a portion of the pumped fluid may be diverted into the flow control valve 300 through the entry port 360. In one implementation, the amount of pressure generated by the fluid against the ball 314 may overcome the predetermined amount of force exerted by the spring 316 against the ball 314 such that the ball 314 may be removed from the ball seat 312, thereby creating a flow path 315 for the fluid to enter a chamber 370 and exit through the exit port 390. Upon exiting the exit port 390, the fluid may continue to flow into the formation 350. However, when the fluid flows back from the formation 350 toward the flow control valve 300, the pressure generated by the fluid and the spring 316 may press the ball 314 against the ball seat 312 to close the flow path 315, which had been opened earlier. In this manner, the check valve assembly 310 may be configured to prevent fluid from the formation 350 to reenter the completion string 330 through the flow control valve 300. Since the amount of fluid reentering the completion string 330 may virtually be eliminated, the effects of the pressure waves generated by the fluid reverberating through the completion string 330 may be minimized. In one implementation, the size of the ball 314 may be selected to be large enough to close off the opening formed by the shape of the ball seat 312, yet small enough to allow fluid to pass around the ball 314 into the chamber 370. Although the flow control valve 300 is described herein as having a spring 316, it should be understood that in some implementations, the flow path 315 may be opened or closed using other means, such as by allowing the ball 314 to move only upon applied fluid pressure from either the completion string 330 or the formation 350. Although the check valve is described herein using a ball seat, a ball and a spring, it should be understood that, in some implementations, other types of check valves, such as poppet valves, cone seats, or other geometries suitable to form a back check valve, may be used.

Although the flow control valve is described herein with reference to minimizing the hammer effect, it should be understood that, in some implementations, the flow control valve may be applied to treat multiple zone completions. In multiple zone completions, cross flow between zones may occur through the completion string when different pressures exist in different zones. Higher pressure zones may push fluid back into the wellbore and into other zones in an effort to equalize pressure, particularly if fluid supply from the surface is stopped and the well seeks its natural pressure equilibrium. Accordingly, in one implementation, multiple flow control valves may be mounted on the completion string to match the corresponding number of multiple zones. Each flow control valve may be used to prevent back flow from its corresponding zone by closing when the pressure of the zone begins to push fluid back into the completion string. In this manner, the above referenced implementations may be used to prevent cross flow between multiple zones.

Although the tubular members have been depicted in the figures as having circular cross sections, it should be understood that, in some implementations, these tubular members may have non-circular cross sections, such as oval, kidney-shaped and the like. Further, although the flow control valve has been described as being mounted to a side portion of a completion string, it should be understood that, in some implementations, the flow control valve may be mounted in a different configuration, such as in-line with the main axis of the completion string as may be accomplished with annular or ball choking valves. Further, although the flow control valve has been described with reference to fluid flowing through the completion string, it should be understood that in some implementations, the flow control valve may be used with other types of injection medium, such as gas or vapor (e.g., steam).

While the foregoing is directed to implementations of various technologies described herein, other and further implementations may be devised without departing from the basic scope thereof, which may be determined by the claims that follow. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method for injecting fluid into an earth formation through a completion string having one or more flow control valves disposed thereon, comprising:

providing a completion string having one or more flow control valves positioned eccentric to the completion string; each flow control valve comprising:

a chamber having an entry port and an exit port;

a moveable choke positioned in the chamber proximate to the exit port; and configured to operate independently of a check valve assembly positioned in the chamber;

wherein the check valve assembly comprises:

a ball seat having an opening;

a ball configured to sealably couple wit the ball seat; and a spring coupled to the ball, wherein the spring biases the ball towards a position in which the opening is sealed;

deploying the completion string inside a wellbore such that the one or more flow control valves are positioned proximate one or more earth formations;

coupling a high pressure pump with the completion string;

pumping fluid under high pressure, via the high pressure pump, from the surface into the completion string;

discharging the high-pressure fluid into the wellbore through the exit port; and blocking return flow through the exit port of the flow control valve upon cessation of pumping.

2. The method of claim 1, wherein the spring is configured to press the ball against the ball seat when the check valve assembly is in a closed position.

3. The method of claim 1, wherein the check valve assembly further comprises a flow path through the opening of the ball seat around the ball when the check valve assembly is in an open position.

4. The method of claim 1, wherein the moveable choke is configured to cover at least a portion of the exit port.

5. The method of claim 4, further comprising closing fluid flow path from the one of the earth formations back to the completion string once pressure inside the completion string is less than pressure inside the one of the earth formations.

6. The method of claim 4, wherein the fluid flow path from the one of the earth formations back to the completion string is closed by moving the moveable choke to cover the exit port.

* * * * *